US011107380B2

(12) United States Patent
Wang

(10) Patent No.: US 11,107,380 B2
(45) Date of Patent: Aug. 31, 2021

(54) GOA UNIT AND METHOD OF DRIVING THE SAME, GOA CIRCUIT AND DISPLAY APPARATUS

(71) Applicants: BOE TECHNOLOGY GROUP CO., LTD., Beijing (CN); ORDOS YUANSHENG OPTOELECTRONICS CO., LTD., Inner Mongolia (CN)

(72) Inventor: Bo Wang, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 722 days.

(21) Appl. No.: 15/775,463

(22) PCT Filed: Nov. 21, 2017

(86) PCT No.: PCT/CN2017/112088
§ 371 (c)(1),
(2) Date: May 11, 2018

(87) PCT Pub. No.: WO2018/133520
PCT Pub. Date: Jul. 26, 2018

(65) Prior Publication Data

US 2021/0209981 A1 Jul. 8, 2021

(30) Foreign Application Priority Data

Jan. 20, 2017 (CN) ..... 201710041956.X

(51) Int. Cl.
*G09G 5/00* (2006.01)
*G09G 3/20* (2006.01)

(52) U.S. Cl.
CPC ..... *G09G 3/20* (2013.01); *G09G 2300/0408* (2013.01); *G09G 2300/0852* (2013.01);
(Continued)

(58) Field of Classification Search
CPC ..... G09G 3/20; G09G 2300/0408; G09G 2300/0852; G09G 2310/0267; G09G 2310/061
See application file for complete search history.

(56) References Cited

U.S. PATENT DOCUMENTS 7,595,783 B2 9/2009 Cho et al.
2006/0145999 A1 7/2006 Cho et al.
(Continued)

FOREIGN PATENT DOCUMENTS

CN 101089939 A 12/2007
CN 104282285 A 1/2015
(Continued)

OTHER PUBLICATIONS

International search report dated Nov. 21, 2017 for corresponding application No. PCT/CN2017/112088 with English translation attached.
(Continued)

*Primary Examiner* — Adam J Snyder
(74) *Attorney, Agent, or Firm* — Nath, Goldberg & Meyer; Joshua B. Goldberg

(57) ABSTRACT

The present disclosure provides a gate driver-on-array (GOA) unit and a method of driving the same, a GOA circuit, and a display apparatus. The GOA unit includes a pulling-up circuit, a pulling-down circuit and an output holding circuit. The pulling-up circuit is configured to output a gate scanning signal from the output terminal, under the control of a trigger signal, a first control signal and a second control signal. The output holding circuit is configured to hold the gate scanning signal output from the output termi-
(Continued)

nal, under the control of the trigger signal, the first control signal and the second control signal. The pulling-down circuit is configured to reset the gate scanning signal and hold the gate scanning signal in a reset state for a set time period, under the control of the trigger signal, the first control signal and the second control signal.

16 Claims, 4 Drawing Sheets

(52) U.S. Cl.
CPC ..... *G09G 2310/0267* (2013.01); *G09G 2310/061* (2013.01)

(56) References Cited

U.S. PATENT DOCUMENTS

2012/0044133 A1 2/2012 Nakamizo et al.
2012/0269315 A1* 10/2012 Jang ..... G11C 19/00 377/75
2014/0064436 A1* 3/2014 Ma ..... G09G 3/3266 377/64
2016/0189796 A1* 6/2016 Wu ..... G09G 5/003 345/211
2018/0151146 A1* 5/2018 Chang ..... G11C 19/28

FOREIGN PATENT DOCUMENTS

CN 104835475 A 8/2015
CN 205564249 U 9/2016
CN 106128347 A 11/2016
CN 106157874 A 11/2016
CN 106548744 A 3/2017
WO 2010/097986 A1 9/2010
WO 2010097986 A1 9/2010

OTHER PUBLICATIONS

Office Action dated Dec. 17, 2018 issued in corresponding Chinese Application No. 201710041956.X.

* cited by examiner

GOA UNIT AND METHOD OF DRIVING THE SAME, GOA CIRCUIT AND DISPLAY APPARATUS

CROSS-REFERENCE TO RELATED APPLICATIONS

This is a National Phase Application filed under 35 U.S.C. 371 as a national stage of PCT/CN2017/112088, filed on Nov. 21, 2017, an application claiming the benefit of Chinese Patent Application No. 201710041956.X, filed on Jan. 20, 2017, the contents of which are incorporated by reference in the entirety.

TECHNICAL FIELD

The present disclosure relates to the field of display technologies, and particularly, to a gate driver-on-array (GOA) unit and a method of driving the same, a GOA circuit, and a display apparatus.

BACKGROUND

In liquid crystal display (LCD) apparatuses and organic light emitting diode (OLED) display apparatuses, pixels are typically controlled by thin film transistors (TFTs) to realize an image display. Controls on the pixels include a row-control and a column-control. The row-control is performed by a GOA circuit to scan the pixels row by row, while the column-control is performed by a data driving circuit to transmit display data of the pixels. A conventional GOA circuit includes a plurality of cascaded GOA units, each of which has a same circuit configuration.

SUMMARY

In an aspect, the present disclosure provides a gate driver-on-array (GOA) unit including a pulling-up circuit, a pulling-down circuit and an output holding circuit. The pulling-up circuit, the pulling-down circuit and the output holding circuit are coupled with an output terminal of the GOA unit. The pulling-up circuit and the output holding circuit are coupled with a pulling-up node. The pulling-up circuit and the pulling-down circuit are coupled with a pulling-down node. The pulling-down circuit is coupled with a low voltage level terminal and a first voltage level terminal. The pulling-up circuit is coupled with a high voltage level terminal, the first voltage level terminal and a second voltage level terminal. The output holding circuit is coupled with the second voltage level terminal. The pulling-up circuit is configured to output a gate scanning signal from the output terminal, under the control of a trigger signal, a first control signal and a second control signal; the output holding circuit is configured to hold the gate scanning signal output from the output terminal, under the control of the trigger signal, the first control signal and the second control signal; and the pulling-down circuit is configured to reset the gate scanning signal and hold the gate scanning signal in a reset state for a set time period, under the control of the trigger signal, the first control signal and the second control signal.

Optionally, the output holding circuit includes a ninth transistor and a third capacitor; a first end of the third capacitor and a gate electrode and a first electrode of the ninth transistor are coupled with the pulling-up node; a second end of the third capacitor is coupled with the output terminal; and a second electrode of the ninth transistor is coupled with the second voltage level terminal.

Optionally, the pulling-up circuit includes a first capacitor, a fourth transistor, a fifth transistor and a seventh transistor; a first end of the first capacitor is coupled with a terminal for providing the first control signal, and a second end of the first capacitor is coupled with a gate electrode of the fourth transistor and the pulling-down circuit; a first electrode of the fourth transistor is coupled with a gate electrode of the fifth transistor, the pulling-up node and a gate electrode of the seventh transistor, and a second electrode of the fourth transistor is coupled with the second voltage level terminal; a first electrode of the fifth transistor is coupled with the pulling-down node, and a second electrode of the fifth transistor is coupled with the first voltage level terminal; and a first electrode of the seventh transistor is coupled with the output terminal, and a second electrode of the seventh transistor is coupled with the high voltage level terminal.

Optionally, the pulling-up circuit further includes an eighth transistor; a gate electrode of the eighth transistor is coupled with the pulling-up node, a first electrode of the eighth transistor is coupled with the pulling-down node, and a second electrode of the eighth transistor is coupled with the first voltage level terminal.

Optionally, the pulling-down circuit includes a first transistor, a second transistor, a third transistor, a sixth transistor and a second capacitor; a gate electrode of the first transistor is coupled with a terminal for providing the trigger signal and a first electrode of the second transistor, a first electrode of the first transistor is coupled with the first voltage level terminal, and a second electrode of the first transistor is coupled with the pulling-up circuit; a gate electrode of the second transistor is coupled with the terminal for providing the first control signal, and a second electrode of the second transistor is coupled with the pulling-down node; a gate electrode of the third transistor is coupled with a gate electrode of the sixth transistor, a first end of the second capacitor and the pulling-down node, a first electrode of the third transistor is coupled with the first voltage level terminal, and a second electrode of the third transistor is coupled with the pulling-up circuit; a second end of the second capacitor is coupled with a terminal for providing the second control signal; and a first electrode of the sixth transistor is coupled with the low voltage level terminal, and a second electrode of the sixth transistor is coupled with the output terminal.

Optionally, the first voltage level terminal is of a high voltage level, and the second voltage level terminal is of a low voltage level; and the first transistor, the second transistor, the third transistor, the fourth transistor, the fifth transistor, the sixth transistor, the seventh transistor, the eighth transistor and the ninth transistor are each a P-type transistor.

Optionally, the first voltage level terminal is of a low voltage level, and the second voltage level terminal is of a high voltage level; and the first transistor, the second transistor, the third transistor, the fourth transistor, the fifth transistor, the sixth transistor, the seventh transistor, the eighth transistor and the ninth transistor are each an N-type transistor.

In another aspect, the present disclosure provides a gate driver-on-array (GOA) circuit, which includes any one of the GOA units described herein.

In another aspect, the present disclosure provides a display apparatus, which includes the GOA circuit described herein.

In another aspect, the present disclosure provides a method of driving any one of the above GOA units, including: in a pulling-up stage, outputting, by the pulling-up circuit under the control of the trigger signal, the first control signal and the second control signal, a gate scanning signal from the output terminal of the GOA unit; in an output holding stage, holding, by the output holding circuit under the control of the trigger signal, the first control signal and the second control signal, the gate scanning signal output from the output terminal; in a pulling-down stage, resetting the gate scanning signal by the pulling-down circuit under the control of the trigger signal, the first control signal and the second control signal; and in a pulling-down holding stage, holding, by the pulling-down circuit under the control of the trigger signal, the first control signal and the second control signal, the gate scanning signal in a reset state for a set time period.

BRIEF DESCRIPTION OF THE DRAWINGS

The following drawings are merely examples for illustrative purposes according to various disclosed embodiments and are not intended to limit the scope of the present invention, in which.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

In a conventional gate driver-on-array (GOA) circuit, it suffers from unstable output signals of GOA units, for example, the GOA units of the GOA circuit often output a signal with an unsmooth waveform. Moreover, the difference in amplitude between a waveform of an output signal of a GOA unit and a waveform of an input signal of the GOA unit, based on which the output signal is generated, is relatively large, resulting in that the GOA circuit cannot scan and drive the pixels row by row in a stable manner. As a result, the LCD apparatus or the OLED apparatus, in which the GOA circuit is used, cannot perform an image display in a stable manner.

Accordingly, the present disclosure provides, inter alia, a gate driver-on-array (GOA) unit and a method of driving the same, a GOA circuit, and a display apparatus that substantially obviate one or more of the problems due to limitations and disadvantages of the related art.

Figure 1:
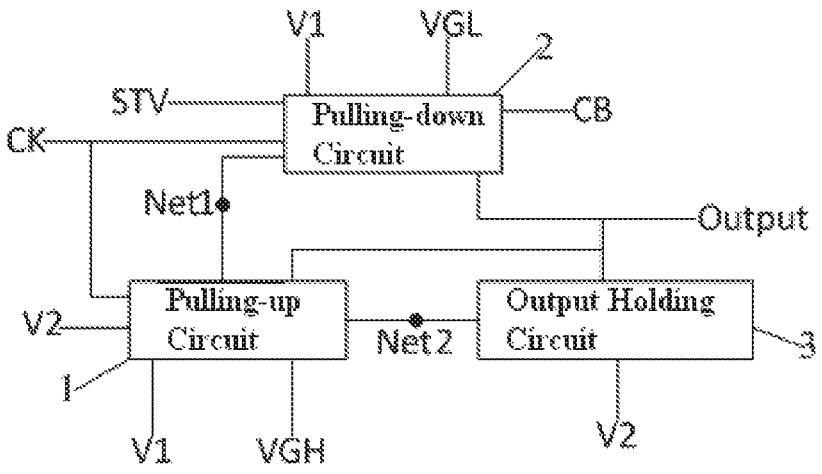
FIG. 1 is a schematic circuit diagram of a gate driver-on-array (GOA) unit according to an embodiment of the present disclosure.

In an aspect, embodiments of the present disclosure provide a gate driver-on-array (GOA) unit. FIG. 1 is a schematic circuit diagram of a gate driver-on-array (GOA) unit according to an embodiment of the present disclosure. A shown in FIG. 1, the GOA unit includes a pulling-up circuit 1, a pulling-down circuit 2 and an output holding circuit 3. The pulling-up circuit 1, the pulling-down circuit 2 and the output holding circuit 3 are coupled with an output terminal Output of the GOA unit. The pulling-up circuit 1 and the output holding circuit 3 are coupled with a pulling-up node Net2. The pulling-up circuit 1 and the pulling-down circuit 2 are coupled with a pulling-down node Net1. The pulling-down circuit 2 is coupled with a low voltage level terminal VGL and a first voltage level terminal V1. The pulling-up circuit 1 is coupled with a high voltage level terminal VGH, the first voltage level terminal V1 and a second voltage level terminal V2. The output holding circuit 3 is coupled with the second voltage level terminal V2. The pulling-up circuit 1 is configured to output a gate scanning signal from the output terminal Output, under the control of a trigger signal STV, a first control signal CK and a second control signal CB. The output holding circuit 3 is configured to hold the gate scanning signal output from the output terminal Output, under the control of the trigger signal STV, the first control signal CK and the second control signal CB. The pulling-down circuit 2 is configured to reset the gate scanning signal and hold the gate scanning signal in a reset state for a set time period, under the control of the trigger signal STV, the first control signal CK and the second control signal CB.

By having the output holding circuit 3, the present GOA unit is capable of outputting a gate scanning signal from the output terminal Output thereof in a more stable manner. The gate scanning signal, compared to that in the related art, has a smoother waveform and a reduced difference in amplitude between the waveform of the gate scanning signal and a waveform of an input signal, based on which the gate scanning signal is generated. As a result, the present GOA unit is capable of performing a scanning and driving operation in a more stable manner.

Figure 2:
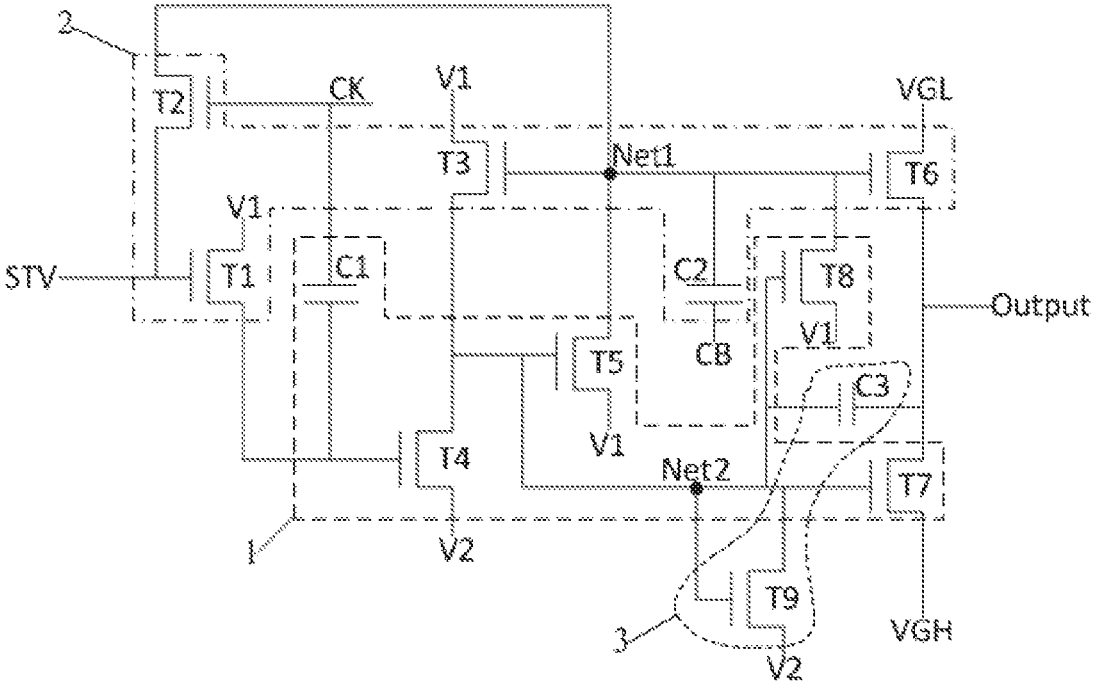
FIG. 2 is a circuit diagram of a GOA unit according to an embodiment of the present disclosure.

FIG. 2 is a circuit diagram of a GOA unit according to an embodiment of the present disclosure. As shown in FIG. 2, the output holding circuit 3 in the present embodiment includes a ninth transistor T9 and a third capacitor C3; a first end of the third capacitor C3 and a gate electrode and a first electrode of the ninth transistor T9 are coupled with the pulling-up node Net2, a second end of the third capacitor C3 is coupled with the output terminal Output; and a second electrode of the ninth transistor T9 is coupled with the second voltage level terminal V2.

The pulling-up circuit 1 in the present embodiment includes a first capacitor C1, a fourth transistor T4, a fifth transistor T5 and a seventh transistor T7. A first end of the first capacitor C1 is coupled with a terminal for providing the first control signal CK, and a second end of the first capacitor C1 is coupled with a gate electrode of the fourth transistor T4 and the pulling-down circuit 2. A first electrode of the fourth transistor T4 is coupled with a gate electrode of the fifth transistor T5, the pulling-up node Net2 and a gate electrode of the seventh transistor T7, and a second electrode of the fourth transistor T4 is coupled with the second voltage level terminal V2. A first electrode of the fifth transistor T5 is coupled with the pulling-down node Net1, and a second electrode of the fifth transistor T5 is coupled with the first voltage level terminal V1. A first electrode of the seventh transistor T7 is coupled with the output terminal Output, and a second electrode of the seventh transistor T7 is coupled with the high voltage level terminal VGH.

Optionally, the pulling-up circuit 1 in the present embodiment further includes an eighth transistor T8. A gate electrode of the eighth transistor T8 is coupled with the pulling-up node Net2, a first electrode of the eighth transistor T8 is coupled with the pulling-down node Net1, and a second electrode of the eighth transistor T8 is coupled with the first voltage level terminal V1. By having the eighth transistor T8, the present GOA unit is capable of further switching off the pulling-down circuit 2 in an output holding stage, thereby preventing the pulling-down circuit 2 from disturbing the gate scanning signal. As a result, the present GOA unit can output the gate scanning signal in a more stable manner.

In the present embodiment, the pulling-down circuit 2 includes a first transistor T1, a second transistor T2, a third transistor T3, a sixth transistor T6 and a second capacitor C2. A gate electrode of the first transistor T1 is coupled with a terminal for providing the trigger signal STV and a first electrode of the second transistor T2, a first electrode of the first transistor T1 is coupled with the first voltage level terminal V1, and a second electrode of the first transistor T1 is coupled with the pulling-up circuit 1. A gate electrode of the second transistor T2 is coupled with the terminal for providing the first control signal CK, and a second electrode of the second transistor T2 is coupled with the pulling-down node Net1. A gate electrode of the third transistor T3 is coupled with a gate electrode of the sixth transistor T6, a first end of the second capacitor C2 and the pulling-down node Net1, a first electrode of the third transistor T3 is coupled with the first voltage level terminal V1, and a second electrode of the third transistor T3 is coupled with the pulling-up circuit 1. A second end of the second capacitor C2 is coupled with a terminal for providing the second control signal CB. A first electrode of the sixth transistor T6 is coupled with the low voltage level terminal VGL, and a second electrode of the sixth transistor T6 is coupled with the output terminal Output.

In the present embodiment, the first voltage level terminal V1 is of a high voltage level, and the second voltage level terminal V2 is of a low voltage level; and the first transistor T1, the second transistor T2, the third transistor T3, the fourth transistor T4, the fifth transistor T5, the sixth transistor T6, the seventh transistor T7, the eighth transistor T8 and the ninth transistor T9 are each a P-type transistor.

Figure 3:
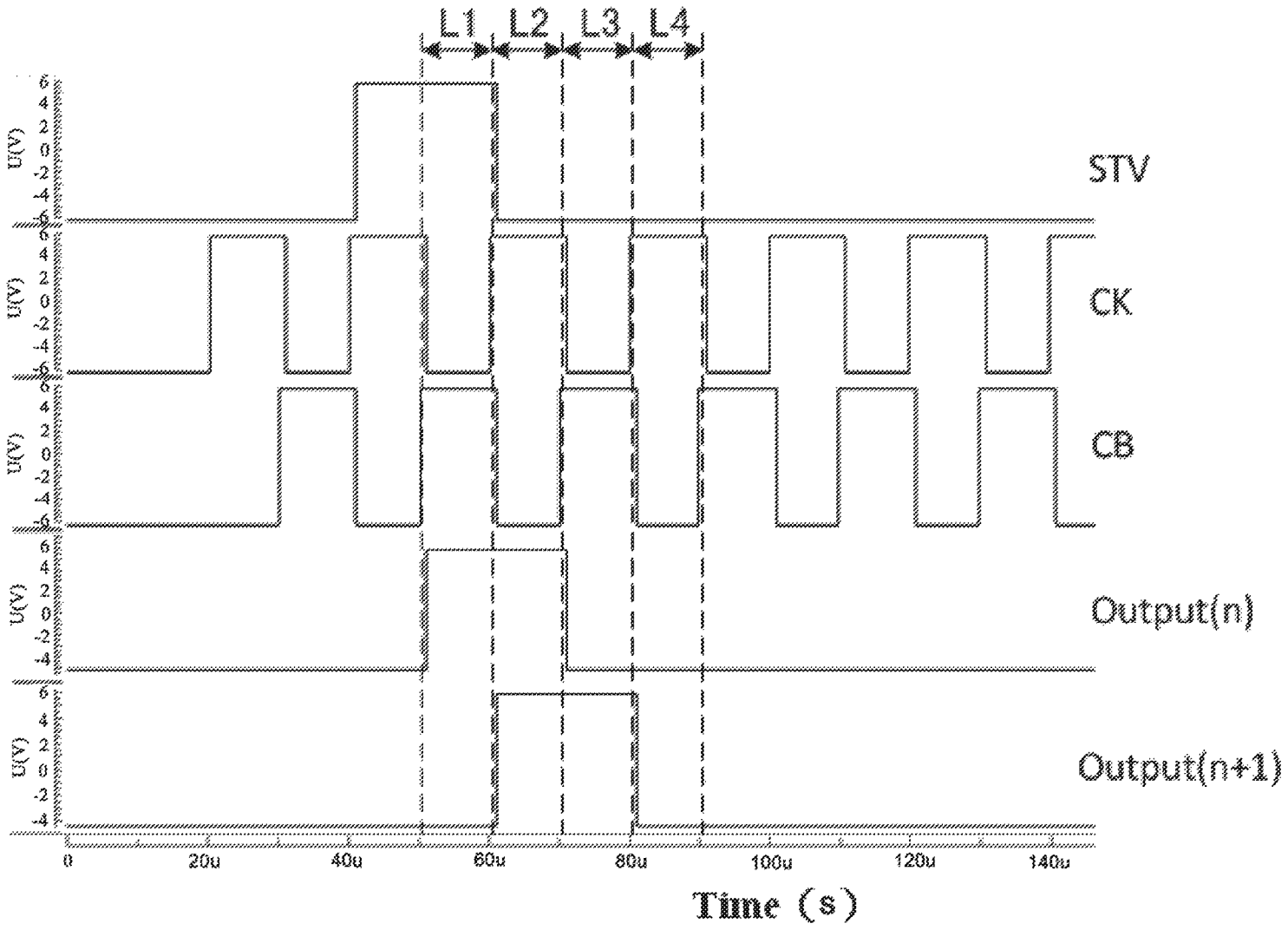
FIG. 3 is a timing diagram illustrating a process of driving the GOA unit in FIG. 2.

Based on the structure of the circuit of the above GOA unit, the present embodiment further provides a method of driving the GOA unit. FIG. 3 is a timing diagram illustrating a process of driving the GOA unit in FIG. 2. Next, the driving method will be described with reference to FIGS. 2 and 3.

As shown in FIG. 3, the driving method includes: in a pulling-up stage L1, outputting, by the pulling-up circuit 1 under the control of the trigger signal STV, the first control signal CK and the second control signal CB, a gate scanning signal from the output terminal Output of the GOA unit.

In the pulling-up stage L1, the trigger signal STV is of a high voltage level, the first control signal CK is of a low voltage level, and the second control signal CB is of a high voltage level, thus the second transistor T2 is turned on, a voltage level at the pulling-down node Net1 is pulled up, and the sixth transistor T6 is turned off. Meanwhile, a voltage level at the first end of the first capacitor C1 is pulled down by the first control signal CK, and a voltage level at the gate electrode of the fourth transistor is pulled down to about −6V (volt) by utilizing the capacitance characteristics of the first capacitor C1; at this time, the fourth transistor T4 and the fifth transistor T5 are turned on, the sixth transistor T6 is turned off due to a high voltage level signal input from the first voltage level terminal V1 coupled with the second electrode of the fifth transistor T5 that has turned on, and the seventh transistor T7 is turned on due to a low voltage level signal input from the second voltage level terminal V2 coupled with the second electrode of the fourth transistor T4 that has turned on. As a result, a high voltage level signal (i.e., a gate scanning signal), which is input from the high voltage level terminal VGH, is output from the output terminal Output of the GOA unit. Meanwhile, a low voltage level signal, which is input from the second voltage level terminal V2 coupled with the second electrode of the fourth transistor T4 that has turned on, is stored at the first end (i.e., the pulling-up node Net2) of the third capacitor C3.

The driving method further includes: in an output holding stage L2, holding, by the output holding circuit 3 under the control of the trigger signal STV, the first control signal CK and the second control signal CB, the gate scanning signal output from the output terminal Output.

In the output holding stage L2, the trigger signal STV is of a low voltage level, the first control signal CK is of a high voltage level, and the second control signal CB is of a low voltage level. As the low voltage level signal in the previous stage (i.e., the pulling-up stage L1) is stored at the first end (i.e., the pulling-up node Net2) of the third capacitor C3, the fifth transistor T5 is turned on, and the sixth transistor T6 is turned off due to a high voltage level signal input from the second electrode of the fifth transistor T5. Meanwhile, the eighth transistor T8 is turned on, and the sixth transistor T6 is further turned off due to a high voltage level signal input from the first voltage level terminal V1, which is coupled with the second electrode of the eighth transistor T8. As a result, a low voltage level of the low voltage level terminal VGL, which is coupled with the first electrode of the sixth transistor T6, will not disturb the gate scanning signal output from the GOA unit, such that the output of the gate scanning signal is more stable. The seventh transistor T7 remains on, so the output terminal Output outputs a high voltage level signal (i.e., a gate scanning signal). At this time, the ninth transistor T9 is turned on, a low voltage level signal from the second voltage level terminal V2, which is coupled with the second electrode of the ninth transistor T9, is input to the pulling-up node Net2, and thus the voltage level at the pulling-up node Net2 is further pulled down. As a result, the seventh transistor T7 stably maintains on.

Figure 4:
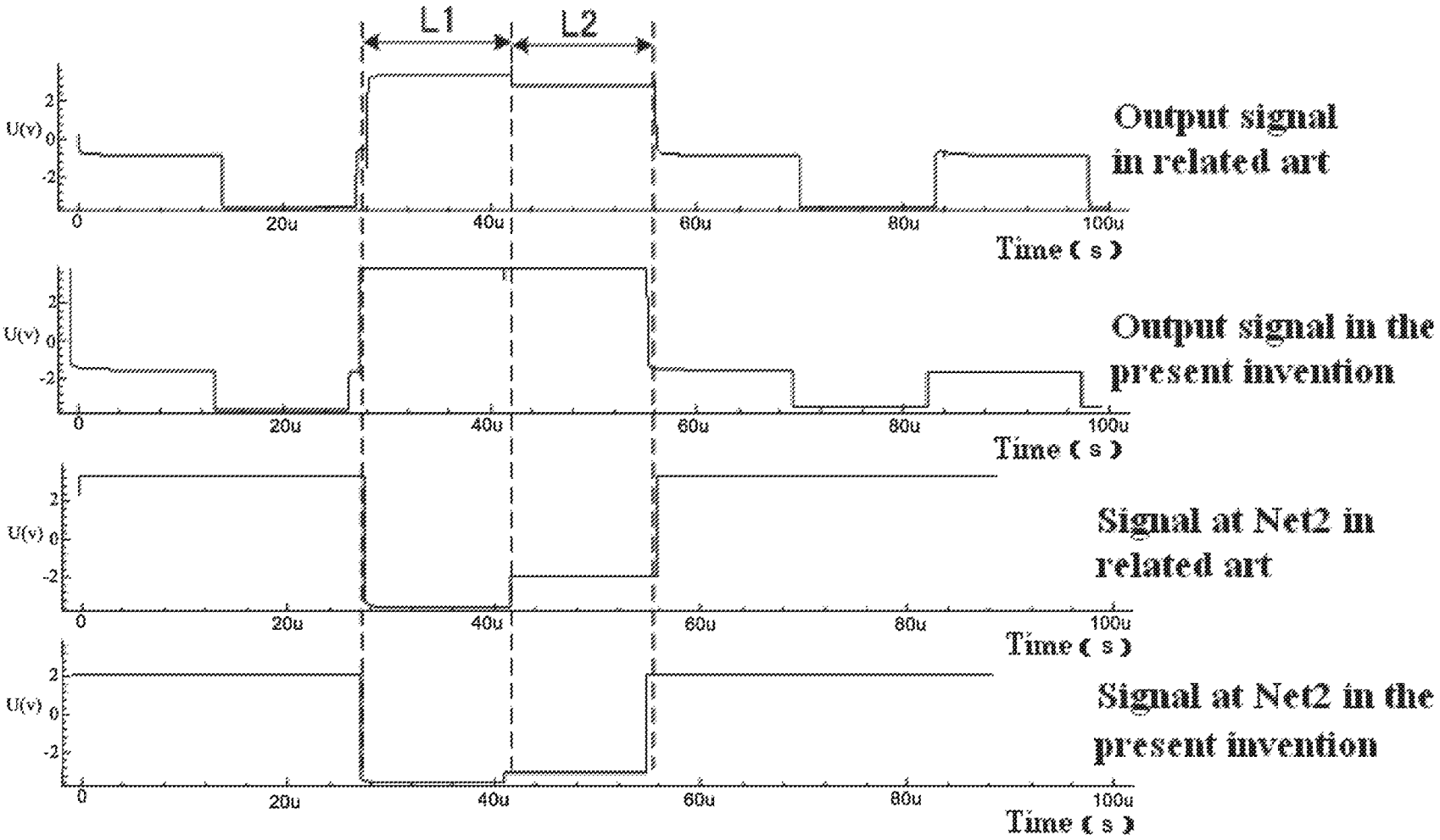
FIG. 4 is diagram illustrating a comparison between an output signal and a signal at a pulling-up node of the GOA unit in FIG. 2 and an output signal and a signal at a pulling-up node of an existing GOA unit.

FIG. 4 is diagram illustrating a comparison between an output signal and a signal at the pulling-up node of the GOA unit in FIG. 2 and an output signal and a signal at a pulling-up node of an existing GOA unit. In the present embodiment, as shown in FIG. 4, by having the third capacitor C3, the low voltage level signal in the previous stage (i.e., the pulling-up stage L1) of the output holding stage L2 is stored at the pulling-up node Net2 (i.e., the first end of the third capacitor C3), so that the fluctuation of the voltage at the pulling-up node Net2 in a transition from the pulling-up stage L1 to the output holding stage L2 is reduced, as compared to a case in which the third capacitor C3 is not provided in the prior art. As a result, the output of the GOA unit is secured to be more stable. Meanwhile, as the low voltage level signal is stored at the first end of the third capacitor C3, the ninth transistor T9 is turned on, and a low voltage level signal from the second voltage level terminal V2, which is coupled with the second electrode of the ninth transistor T9, is input to the pulling-up node Net2, resulting in that the seventh transistor T7 stably maintains on. As a result, compared to a case in which the ninth transistor T9 is not provided in the prior art, it is possible to ensure the gate scanning signal output from the GOA unit in the pulling-up stage L1 and the output holding stage L2 has a smoother waveform, while the difference in amplitude between the waveform of the gate scanning signal and a waveform of an input signal (i.e., a high voltage level signal input from the high voltage level terminal VGH), based on which the gate scanning signal is generated, can be reduced. That is, an amplitude of the waveform of the output gate scanning signal and an amplitude of the waveform of the high voltage level signal input from the high voltage level terminal VGH are substantially the same. As a result, the GOA unit can perform a scanning and driving operation in a more stable manner. As shown in FIG. 4, without provision of the ninth transistor T9 and the third capacitor C3, the smaller the size of a display panel, the higher the voltage level at the pulling-up node Net2 is, resulting in that the seventh transistor T7 is unable to be turned on in the output holding stage L2, thereby adversely affecting output of the GOA unit.

Referring to FIG. 3 again, the driving method further includes: in a pulling-down stage L3, resetting the gate scanning signal by the pulling-down circuit 2 under the control of the trigger signal STV, the first control signal CK and the second control signal CB.

In the pulling-down stage L3, the trigger signal STV is of a low voltage level, the first control signal CK is of a low voltage level, and the second control signal CB is of a high voltage level. As a result, the second transistor T2 is turned on, and the trigger signal STV is input via the first electrode thereof, such that the sixth transistor T6 is turned on, and a low voltage level signal, which is input to the first electrode of the sixth transistor T6, is output from the output terminal Output of the GOA unit. Meanwhile, the first transistor T1 is turned on and a high voltage level signal from the first voltage level terminal V1 is input via the first electrode of the first transistor T1, so the fourth transistor T4 is turned off. The third transistor T3 is turned on and a high voltage level signal from the first voltage level terminal V1 is input via the first electrode of the third transistor T3, so the fifth transistor T5, the seventh transistor T7 and the ninth transistor T9 are turned off, thereby resetting the high-level gate scanning signal output from the output terminal Output.

The driving method further includes: in a pulling-down holding stage L4, holding, by the pulling-down circuit 2 under the control of the trigger signal STV, the first control signal CK and the second control signal CB, the gate scanning signal in a reset state for a set time period.

In the pulling-down holding stage L4, the trigger signal STV is of a low voltage level, the first control signal CK is of a high voltage level and the second control signal CB is of a low voltage level. As a result, a voltage level at the second end of the second capacitor C2 is pulled down by the second control signal CB, and a voltage level at the first end (i.e., the pulling-down node Net1) of the second capacitor C2 is also pulled down at the same time by utilizing the capacitance characteristics of the second capacitor C2. Due to the residual voltage level from the previous stage (i.e., the pulling-down stage L3), the pulling-down node Net1 is pulled down to about −15V, while the sixth transistor T6 maintains on. As a result, the output terminal Output of the GOA unit outputs a low voltage level signal, thereby maintaining the gate scanning signal in a reset state until the next pulling-up stage L1 starts.

An embodiment of the present disclosure further provides a GOA unit, which differs from that in the above embodiment in that, the first voltage level terminal is of a low voltage level, the second voltage level terminal is of a high voltage level, and the first, second, third, fourth, fifth, sixth, seventh, eighth and ninth transistors are each an N-type transistor.

Other circuit structures of the GOA unit in the present embodiment are the same as those in the above embodiments.

Figure 5:
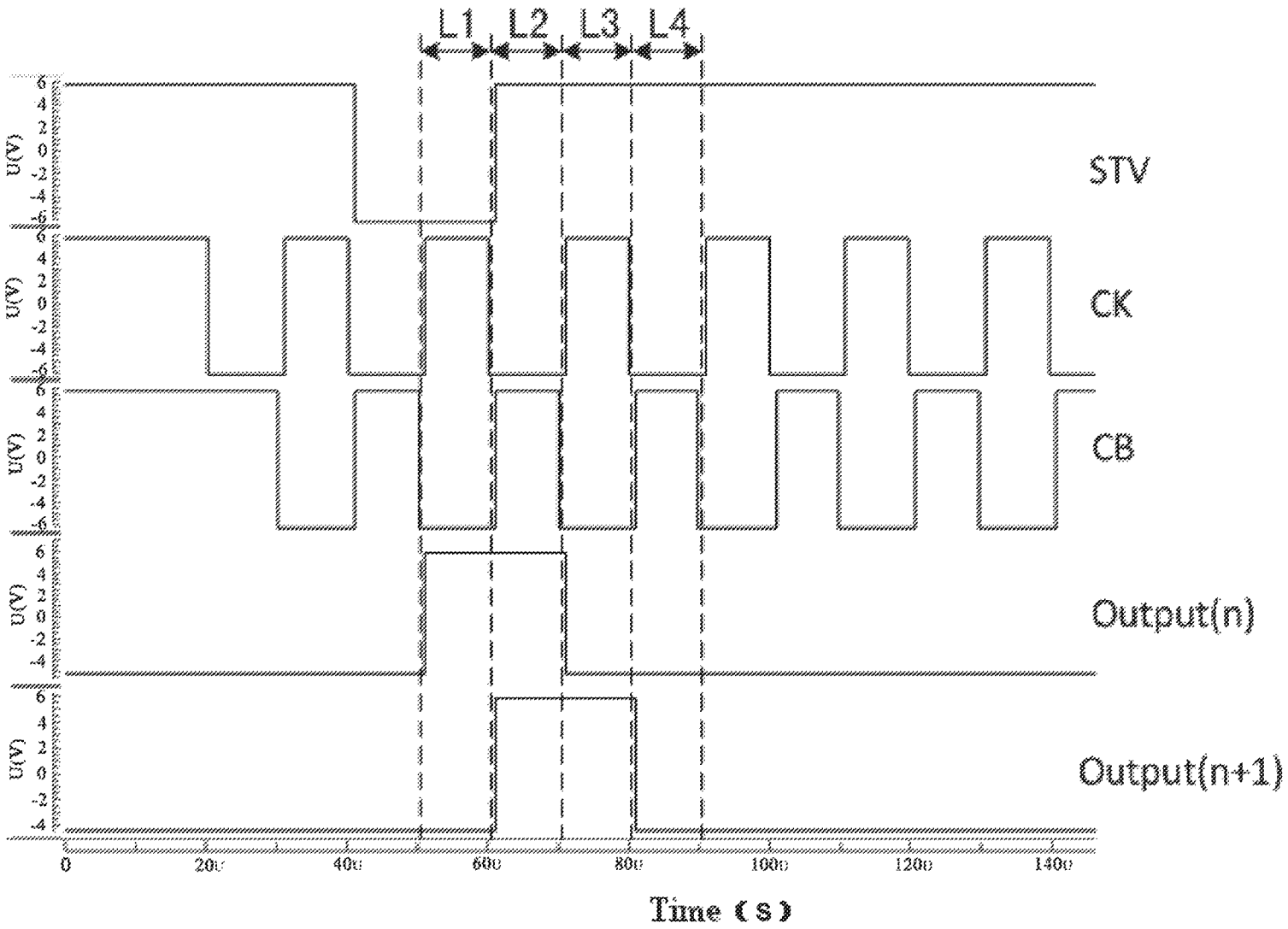
FIG. 5 is a timing diagram illustrating a process of driving a GOA unit according to an embodiment of the present disclosure.

Accordingly, based on the above circuit structures of the GOA unit in the present embodiment, the present embodiment further provides a method of driving the GOA unit. FIG. 5 is a timing diagram illustrating a process of driving a GOA unit according to the present embodiment. As shown in FIG. 5, it differs from the driving method in the above embodiment in that, in each of the pulling-up stage L1, the output holding stage L2, the pulling-down stage L3 and the pulling-down holding stage L4, the trigger signal STV, the first control signal CK and the second control signal CB each has a voltage level opposite to that in the above embodiment.

The steps of the method of driving the GOA unit in the present embodiment are similar to those in the above embodiment, and will not be described herein.

By having the output holding circuit, the GOA unit of the present disclosure is capable of outputting a gate scanning signal from the output terminal of the GOA unit in a more stable manner. The gate scanning signal, compared to that in the related art, has a smoother waveform and a reduced difference in amplitude between the waveform of the gate scanning signal and a waveform of an input signal, based on which the gate scanning signal is generated. As a result, the present GOA unit is capable of performing a scanning and driving operation in a more stable manner.

In another aspect, the present disclosure further provides a gate driver-on-array (GOA) circuit, which includes any one of the above GOA units.

By having any one of the above GOA units provided by the embodiments of the present disclosure, the GOA circuit can scan and drive a gate in a more stable manner.

In another aspect, the present disclosure provides a display apparatus, which includes the GOA circuit provided by the present disclosure.

By having the GOA circuit provided by the present disclosure, the display apparatus can have an improved stability of image display, thereby improving its display effect.

The display apparatus may be any product or part with a display function, such as a liquid crystal display panel, a liquid crystal display television, a display, a mobile phone and a navigator.

It can be understood that the foregoing implementations are merely exemplary implementations used for describing the principle of the present disclosure, but the present disclosure is not limited thereto. Those ordinary skilled in the art may make various variations and improvements without departing from the spirit and essence of the present disclosure, and these variations and improvements shall fall into the protection scope of the present disclosure.

What is claimed is:

1. A gate driver-on-array (GOA) unit, comprising a pulling-up circuit, a pulling-down circuit and an output holding circuit, the pulling-up circuit, the pulling-down circuit and the output holding circuit being coupled with an output terminal of the GOA unit; the pulling-up circuit and the output holding circuit being coupled with a pulling-up node; the pulling-up circuit and the pulling-down circuit being coupled with a pulling-down node; the pulling-down circuit being coupled with a low voltage level terminal and a first voltage level terminal; the pulling-up circuit being coupled with a high voltage level terminal, the first voltage level terminal and a second voltage level terminal; and the output holding circuit being coupled with the second voltage level terminal, wherein the pulling-up circuit is configured to output a gate scanning signal from the output terminal, under control of a trigger signal, a first control signal and a second control signal;

the output holding circuit is configured to hold the gate scanning signal output from the output terminal, under control of the trigger signal, the first control signal and the second control signal; and the pulling-down circuit is configured to reset the gate scanning signal and hold the gate scanning signal in a reset state for a set time period, under control of the trigger signal, the first control signal and the second control signal.

2. The GOA unit of claim 1, wherein the output holding circuit comprises a ninth transistor and a third capacitor;

a first end of the third capacitor and a gate electrode and a first electrode of the ninth transistor are coupled with the pulling-up node; a second end of the third capacitor is coupled with the output terminal; and a second electrode of the ninth transistor is coupled with the second voltage level terminal.

3. The GOA unit of claim 2, wherein the pulling-up circuit comprises a first capacitor, a fourth transistor, a fifth transistor and a seventh transistor;

a first end of the first capacitor is coupled with a terminal for providing the first control signal terminal, and a second end of the first capacitor is coupled with a gate electrode of the fourth transistor and the pulling-down circuit;

a first electrode of the fourth transistor is coupled with a gate electrode of the fifth transistor, the pulling-up node and a gate electrode of the seventh transistor, and a second electrode of the fourth transistor is coupled with the second voltage level terminal;

a first electrode of the fifth transistor is coupled with the pulling-down node, and a second electrode of the fifth transistor is coupled with the first voltage level terminal; and a first electrode of the seventh transistor is coupled with the output terminal, and a second electrode of the seventh transistor is coupled with the high voltage level terminal.

4. The GOA unit of claim 3, wherein the pulling-up circuit further comprises an eighth transistor; a gate electrode of the eighth transistor is coupled with the pulling-up node, a first electrode of the eighth transistor is coupled with the pulling-down node, and a second electrode of the eighth transistor is coupled with the first voltage level terminal.

5. The GOA unit of claim 4, wherein the pulling-down circuit comprises a first transistor, a second transistor, a third transistor, a sixth transistor and a second capacitor;

a gate electrode of the first transistor is coupled with a terminal for providing the trigger signal and a first electrode of the second transistor, a first electrode of the first transistor is coupled with the first voltage level terminal, and a second electrode of the first transistor is coupled with the pulling-up circuit;

a gate electrode of the second transistor is coupled with the terminal for providing the first control signal, and a second electrode of the second transistor is coupled with the pulling-down node;

a gate electrode of the third transistor is coupled with a gate electrode of the sixth transistor, a first end of the second capacitor and the pulling-down node, a first electrode of the third transistor is coupled with the first voltage level terminal, and a second electrode of the third transistor is coupled with the pulling-up circuit; a second end of the second capacitor is coupled with a terminal for providing the second control signal terminal; and a first electrode of the sixth transistor is coupled with the low voltage level terminal, and a second electrode of the sixth transistor is coupled with the output terminal.

6. The GOA unit of claim 5, wherein the first voltage level terminal is of a high voltage level, and the second voltage level terminal is of a low voltage level; and the first transistor, the second transistor, the third transistor, the fourth transistor, the fifth transistor, the sixth transistor, the seventh transistor, the eighth transistor and the ninth transistor are each a P-type transistor.

7. The GOA unit of claim 5, wherein the first voltage level terminal is of a low voltage level, and the second voltage level terminal is of a high voltage level; and the first transistor, the second transistor, the third transistor, the fourth transistor, the fifth transistor, the sixth transistor, the seventh transistor, the eighth transistor and the ninth transistor are each an N-type transistor.

8. A gate driver-on-array (GOA) circuit, comprising the GOA unit according to claim 1.

9. A display apparatus, comprising the GOA circuit according to claim 8.

10. The GOA circuit of claim 8, wherein the output holding circuit comprises a ninth transistor and a third capacitor;

a first end of the third capacitor and a gate electrode and a first electrode of the ninth transistor are coupled with the pulling-up node; a second end of the third capacitor is coupled with the output terminal; and a second electrode of the ninth transistor is coupled with the second voltage level terminal.

11. The GOA circuit of claim 10, wherein the pulling-up circuit comprises a first capacitor, a fourth transistor, a fifth transistor and a seventh transistor;

a first end of the first capacitor is coupled with a terminal for providing the first control signal terminal, and a second end of the first capacitor is coupled with a gate electrode of the fourth transistor and the pulling-down circuit;

a first electrode of the fourth transistor is coupled with a gate electrode of the fifth transistor, the pulling-up node and a gate electrode of the seventh transistor, and a second electrode of the fourth transistor is coupled with the second voltage level terminal;

a first electrode of the fifth transistor is coupled with the pulling-down node, and a second electrode of the fifth transistor is coupled with the first voltage level terminal; and a first electrode of the seventh transistor is coupled with the output terminal, and a second electrode of the seventh transistor is coupled with the high voltage level terminal.

12. The GOA circuit of claim 11, wherein the pulling-up circuit further comprises an eighth transistor; a gate electrode of the eighth transistor is coupled with the pulling-up node, a first electrode of the eighth transistor is coupled with the pulling-down node, and a second electrode of the eighth transistor is coupled with the first voltage level terminal.

13. The GOA circuit of claim 12, wherein the pulling-down circuit comprises a first transistor, a second transistor, a third transistor, a sixth transistor and a second capacitor;

a gate electrode of the first transistor is coupled with a terminal for providing the trigger signal and a first electrode of the second transistor, a first electrode of the first transistor is coupled with the first voltage level terminal, and a second electrode of the first transistor is coupled with the pulling-up circuit;

a gate electrode of the second transistor is coupled with the terminal for providing the first control signal, and a second electrode of the second transistor is coupled with the pulling-down node;

a gate electrode of the third transistor is coupled with a gate electrode of the sixth transistor, a first end of the second capacitor and the pulling-down node, a first electrode of the third transistor is coupled with the first voltage level terminal, and a second electrode of the third transistor is coupled with the pulling-up circuit; a second end of the second capacitor is coupled with a terminal for providing the second control signal terminal; and a first electrode of the sixth transistor is coupled with the low voltage level terminal, and a second electrode of the sixth transistor is coupled with the output terminal.

14. The GOA circuit of claim 13, wherein the first voltage level terminal is of a high voltage level, and the second voltage level terminal is of a low voltage level; and the first transistor, the second transistor, the third transistor, the fourth transistor, the fifth transistor, the sixth transistor, the seventh transistor, the eighth transistor and the ninth transistor are each a P-type transistor.

15. The GOA circuit of claim 13, wherein the first voltage level terminal is of a low voltage level, and the second voltage level terminal is of a high voltage level; and the first transistor, the second transistor, the third transistor, the fourth transistor, the fifth transistor, the sixth transistor, the seventh transistor, the eighth transistor and the ninth transistor are each an N-type transistor.

16. A method of driving a gate driver-on-array (GOA) unit, the GOA unit comprising a pulling-up circuit, a pulling-down circuit and an output holding circuit, the pulling-up circuit, the pulling-down circuit and the output holding circuit being coupled with an output terminal of the GOA unit; the pulling-up circuit and the output holding circuit being coupled with a pulling-up node; the pulling-up circuit and the pulling-down circuit being coupled with a pulling-down node; the pulling-down circuit being coupled with a low voltage level terminal and a first voltage level terminal; the pulling-up circuit being coupled with a high voltage level terminal, the first voltage level terminal and a second voltage level terminal; and the output holding circuit being coupled with the second voltage level terminal, the method comprising:

in a pulling-up stage, outputting, by the pulling-up circuit under control of a trigger signal, a first control signal and a second control signal, a gate scanning signal from the output terminal of the GOA unit;

in an output holding stage, holding, by the output holding circuit under control of the trigger signal, the first control signal and the second control signal, the gate scanning signal output from the output terminal;

in a pulling-down stage, resetting the gate scanning signal by the pulling-down circuit under control of the trigger signal, the first control signal and the second control signal; and in a pulling-down holding stage, holding, by the pulling-down circuit under control of the trigger signal, the first control signal and the second control signal, the gate scanning signal in a reset state for a set time period.

* * * * *